US011090675B2

(12) United States Patent
Renquist et al.

(10) Patent No.: US 11,090,675 B2
(45) Date of Patent: Aug. 17, 2021

(54) SPRINKLER WITH HEIGHT ADJUSTMENT

(71) Applicant: The Toro Company, Bloomington, MN (US)

(72) Inventors: Steven C. Renquist, Norco, CA (US); James T. Wright, III, Riverside, CA (US); Michael Williamson, Kennesaw, GA (US)

(73) Assignee: The Toro Company, Bloomington, MN (US)

( * ) Notice: Subject to any disclaimer, the term of this patent is extended or adjusted under 35 U.S.C. 154(b) by 42 days.

(21) Appl. No.: 16/297,496

(22) Filed: Mar. 8, 2019

(65) Prior Publication Data

US 2019/0275551 A1 Sep. 12, 2019

Related U.S. Application Data

(60) Provisional application No. 62/641,158, filed on Mar. 9, 2018.

(51) Int. Cl.
*B05B 15/68* (2018.01)

(52) U.S. Cl.
CPC ..... *B05B 15/68* (2018.02)

(58) Field of Classification Search
CPC ..... B05B 15/00; B05B 15/14; B05B 15/16; B05B 15/18; B05B 15/68; B05B 15/70; B05B 15/72; B05B 15/74
USPC ..... 239/200–206
See application file for complete search history.

(56) References Cited

U.S. PATENT DOCUMENTS

| | | | | |
|---|---|---|---|---|
| 3,117,724 | A * | 1/1964 | Ray | B05B 15/74 239/97 |
| 5,137,307 | A * | 8/1992 | Kinsey | B05B 15/74 285/133.4 |
| 5,938,121 | A * | 8/1999 | Ferguson | B05B 15/74 239/203 |
| 5,996,905 | A * | 12/1999 | Bedford | B05B 15/74 239/204 |
| 6,193,168 | B1 * | 2/2001 | Bedford | B05B 15/65 239/204 |
| 6,494,386 | B1 * | 12/2002 | Banu | B05B 15/74 239/288 |
| 7,717,360 | B1 * | 5/2010 | Kander | B05B 15/16 239/208 |
| 9,534,778 | B1 * | 1/2017 | Donley, Jr. | F21V 3/02 |
| 2003/0111549 | A1 * | 6/2003 | McNulty | B05B 15/74 239/203 |
| 2011/0042485 | A1 * | 2/2011 | McNulty | B05B 15/628 239/203 |

* cited by examiner

*Primary Examiner* — Darren W Gorman
(74) *Attorney, Agent, or Firm* — Inskeep IP Group, Inc.

(57) ABSTRACT

A sprinkler height adjustment mechanism is described that can be used to increase the height of a top cover and a top of the riser relative to the sprinkler body. The height adjustment mechanism is particularly useful for sprinklers with compartments having removable tops, however, a similar design can also be adapted for sprinklers without compartments (e.g., components that connect to a sprinkler flange or the sprinkler riser).

14 Claims, 16 Drawing Sheets

SPRINKLER WITH HEIGHT ADJUSTMENT

RELATED APPLICATIONS

This application claims priority to U.S. Provisional Application Ser. No. 62/641,158 filed Mar. 9, 2018 entitled Sprinkler With Height Adjustment, which is hereby incorporated herein by reference in its entirety.

BACKGROUND OF THE INVENTION

Irrigation sprinklers are used to irrigate a variety of different types of turf and can be purchased in a wide variety of body styles and configurations. Some turf locations require that an irrigation sprinkler be relatively hidden and obtrusive when not in use. For example, golf courses, sports fields, and even some parks require a uniform surface to prevent injury and/or maintain a consistent playing surface.

One such sprinkler type that is desirable for these uniform locations utilizes a rotating sprinkler riser that elevates in height during irrigation and lowers into a body portion when not in use. Since the body portion is buried in the ground, the overall top of the sprinkler can be generally maintained at the level of the turf when not in use yet can also elevate its sprinkler nozzle to an effective height when active.

One such sprinkler design can be seen in U.S. Pat. No. 9,539,602, which is incorporated herein by reference. In addition to a riser portion that rises and lowers, this sprinkler includes a compartment surrounding the riser, which can contain various sprinkler components such as a pilot valve and two-wire decoder for controlling irrigation.

Over time, sprinklers such as in the '602 patent may move downwards into the ground by several inches, causing a mismatch or depression relative to the elevation of the surrounding turf. An example of this can be seen in FIG. 1, in which the top of the sprinkler 10 is located below the surrounding turf 1. Typically, the sprinkler's height can only be adjusted by first removing the surrounding turf/dirt from the sprinkler, raising the elevation of the sprinkler to a desired height, and replacing the dirt and turf around the sprinkler. Removing and replacing the turf/dirt can be difficult, time-consuming, and can cause temporary damage to the turf. Hence, an easier, less invasive technique of adjusting a sprinkler's height to maintain a uniform, level area of turf is desirable.

SUMMARY OF THE INVENTION

In one embodiment, the present invention is directed to a sprinkler height adjustment mechanism that can be used to increase the height of a top cover and a top of the riser relative to the sprinkler body. In other words, this mechanism prevents the top of the riser from passing through it, to its otherwise normal resting position. The height adjustment mechanism is particularly useful for sprinklers with compartments having removable tops, however, a similar design can also be adapted for sprinklers without compartments (e.g., components that connect to a sprinkler flange or the sprinkler riser).

In one embodiment, the height adjustment mechanism consists of one or more spacer rings. The cover of the sprinkler is removed (as well as the cover of the riser), the one or more spacer rings are placed on the body and properly aligned, then the cover and riser cover are screwed back on, leaving a higher overall top level to the sprinkler.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
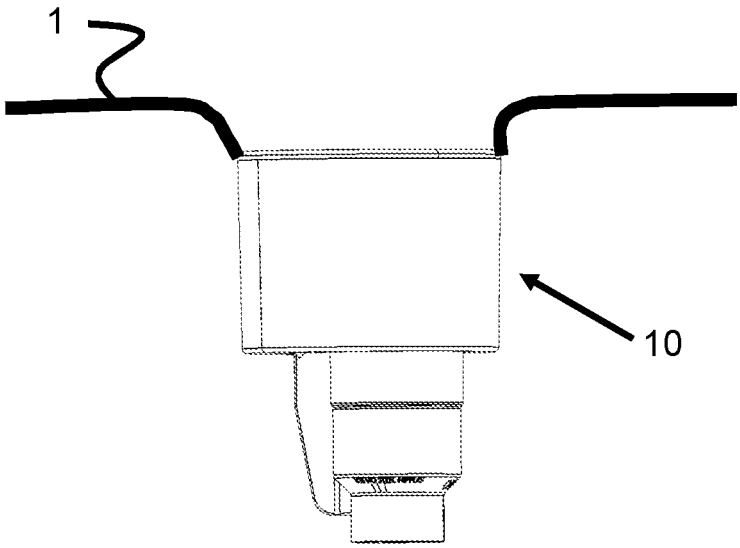
FIG. 1 is a side view of a sprinkler having a top surface that is located below grade or the surrounding turf.
Figure 2:
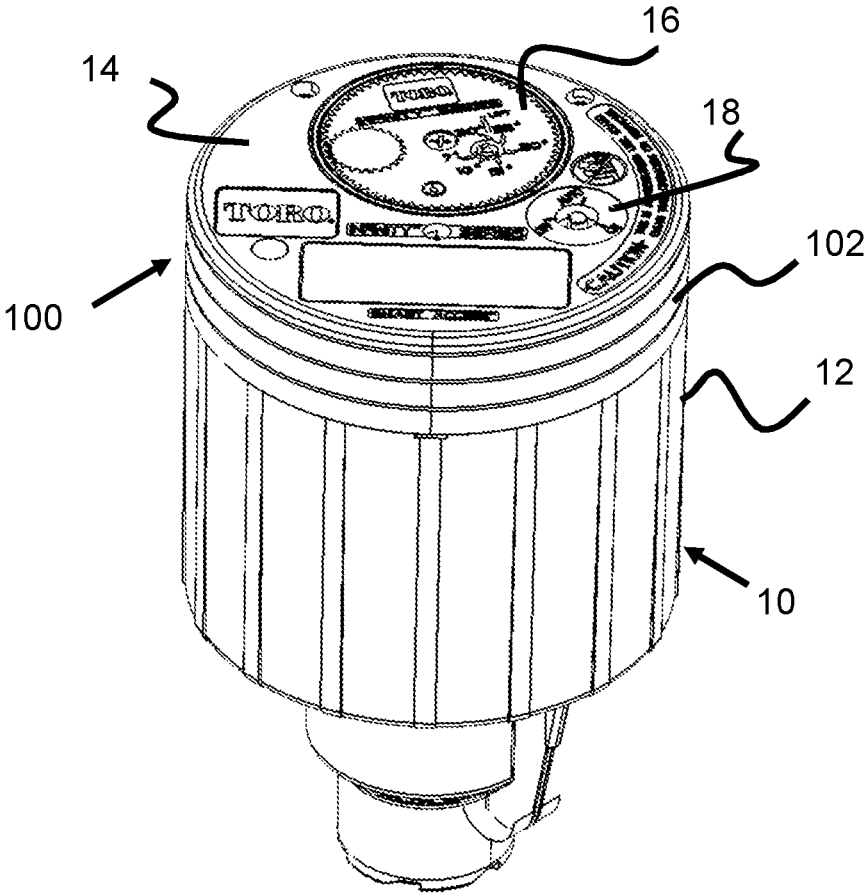
FIG. 2 illustrates a perspective view of a sprinkler with a plurality of spacer rings according to the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

FIGS. 2-17 illustrate various aspects of a sprinkler height adjustment mechanism 100, which can be used to increase the height of the top cover 14 and top of the riser 16 relative to the sprinkler body 10. The height adjustment mechanism 100 is particularly useful for sprinklers with compartments having removable tops, as seen in the figures and in U.S. Pat. No. 9,539,602, however, a similar design can also be adapted for sprinklers without compartments (e.g., components that connect to a sprinkler flange or a top portion of a riser/body).

Figure 3:
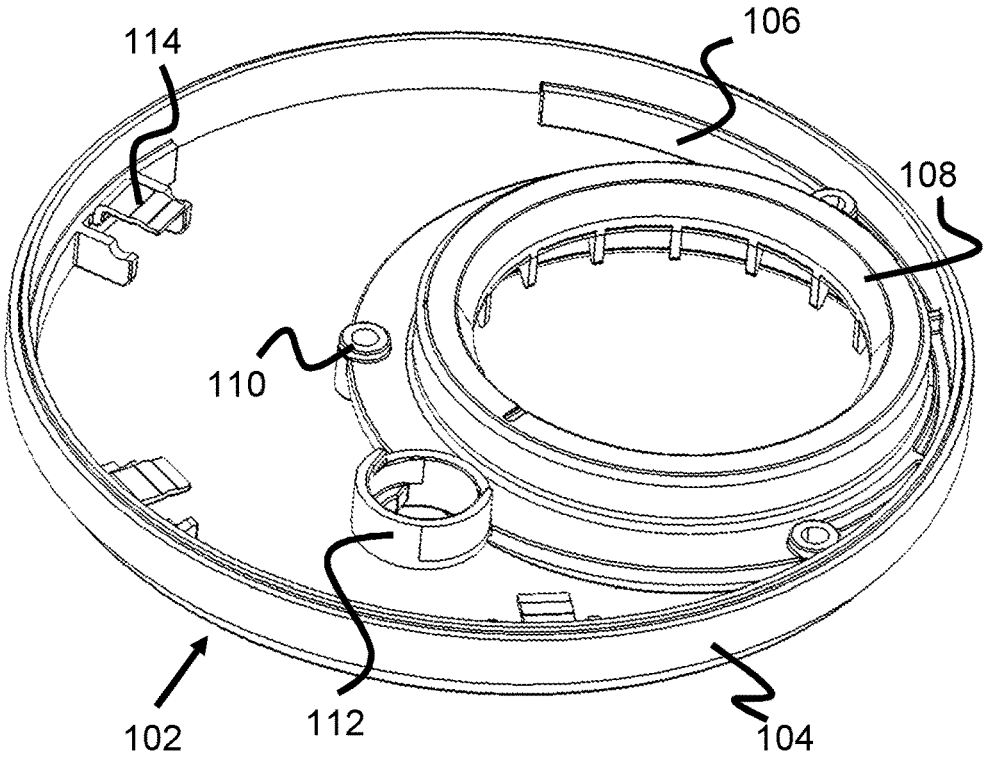
FIG. 3 illustrates a top perspective view of a spacer ring according to the present invention.
Figure 4:
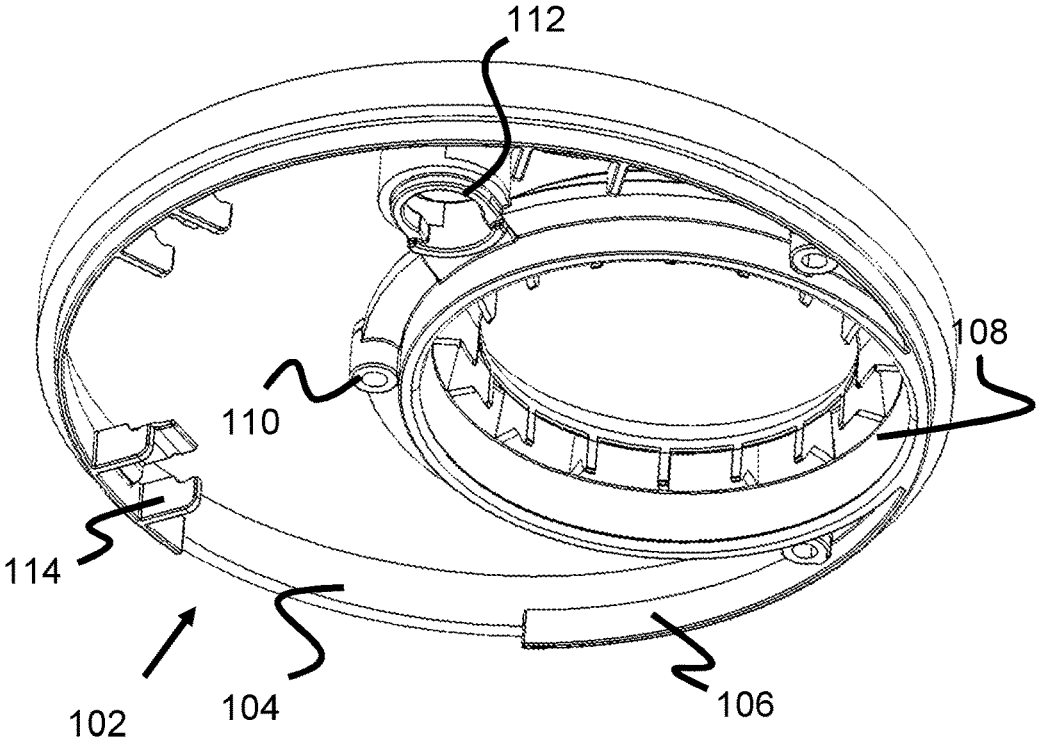
FIG. 4 illustrates a bottom perspective view of a spacer ring according to the present invention.
Figure 5:
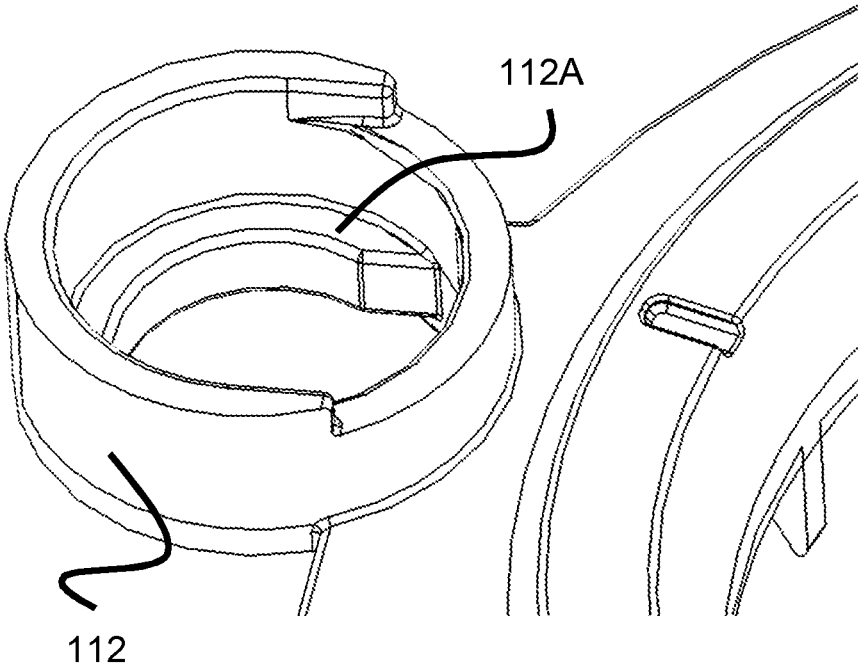
FIG. 5 illustrates a pilot valve adjustment ring according to the present invention.

As best seen in FIGS. 3 and 4, the height adjustment mechanism consists of one or more spacer rings 102. For example, circular, square, rectangle, or any other shapes that are similar in shape and size as the top body of the sprinkler 10. While described as a "ring," the spacer ring may alternately be a plate with apertures through it. The top cover 14 of the sprinkler 10 is removed (as well as the top cover of the riser 16), the one or more spacer rings 102 are placed on the body 12 and properly aligned, then the cover 14 and riser cover are screwed back on, leaving a higher overall top level to the sprinkler 10.

The spacer ring 102 includes a riser ring 108 which is aligned over the riser 16, allowing the riser 16 to move vertically through it. The top cover of the riser 16 is larger in diameter than the riser ring 108 of the spacer ring 102, allowing it to rest on top when lowered to maintain the same elevation as the surrounding cover 14.

Figure 7:
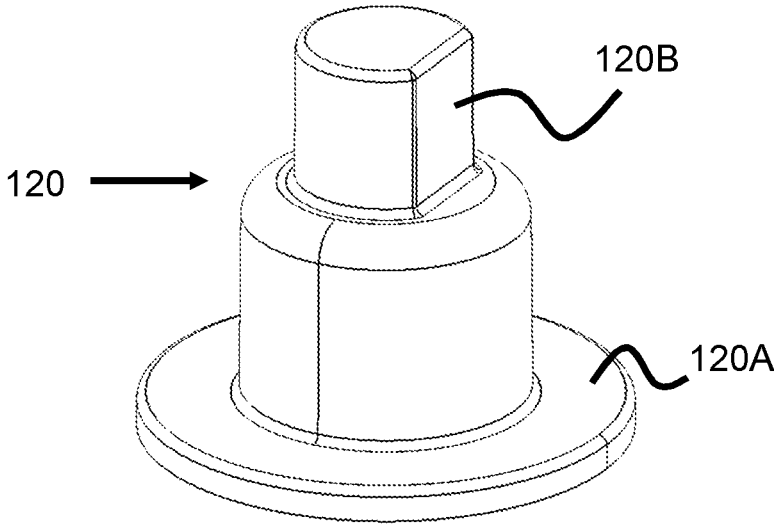
FIG. 7 illustrates a knob adapter according to the present invention.
Figure 8:
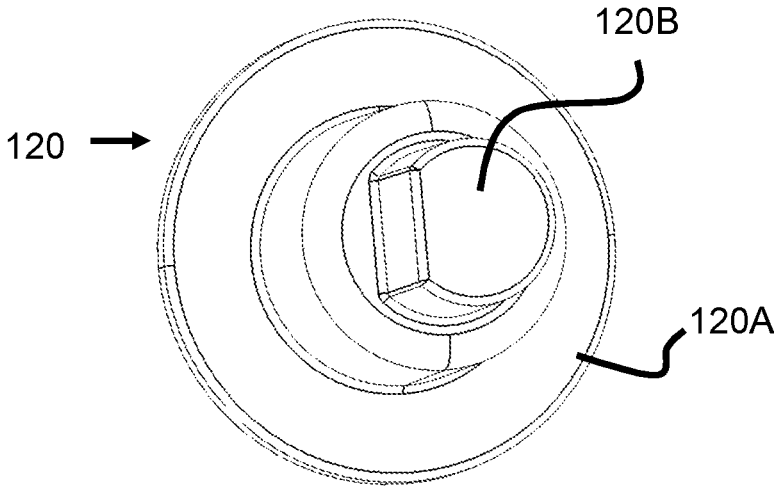
FIG. 8 illustrates a knob adapter according to the present invention.
Figure 9:
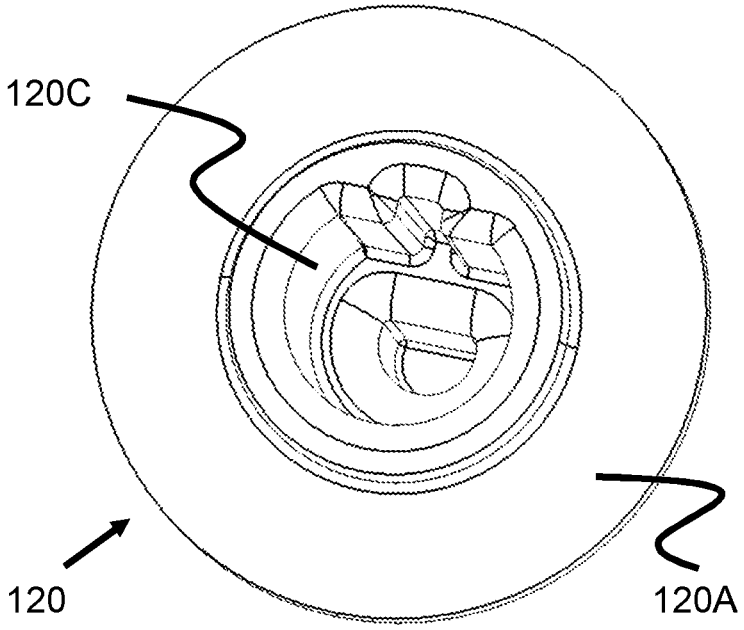
FIG. 9 illustrates a knob adapter according to the present invention.
Figure 10:
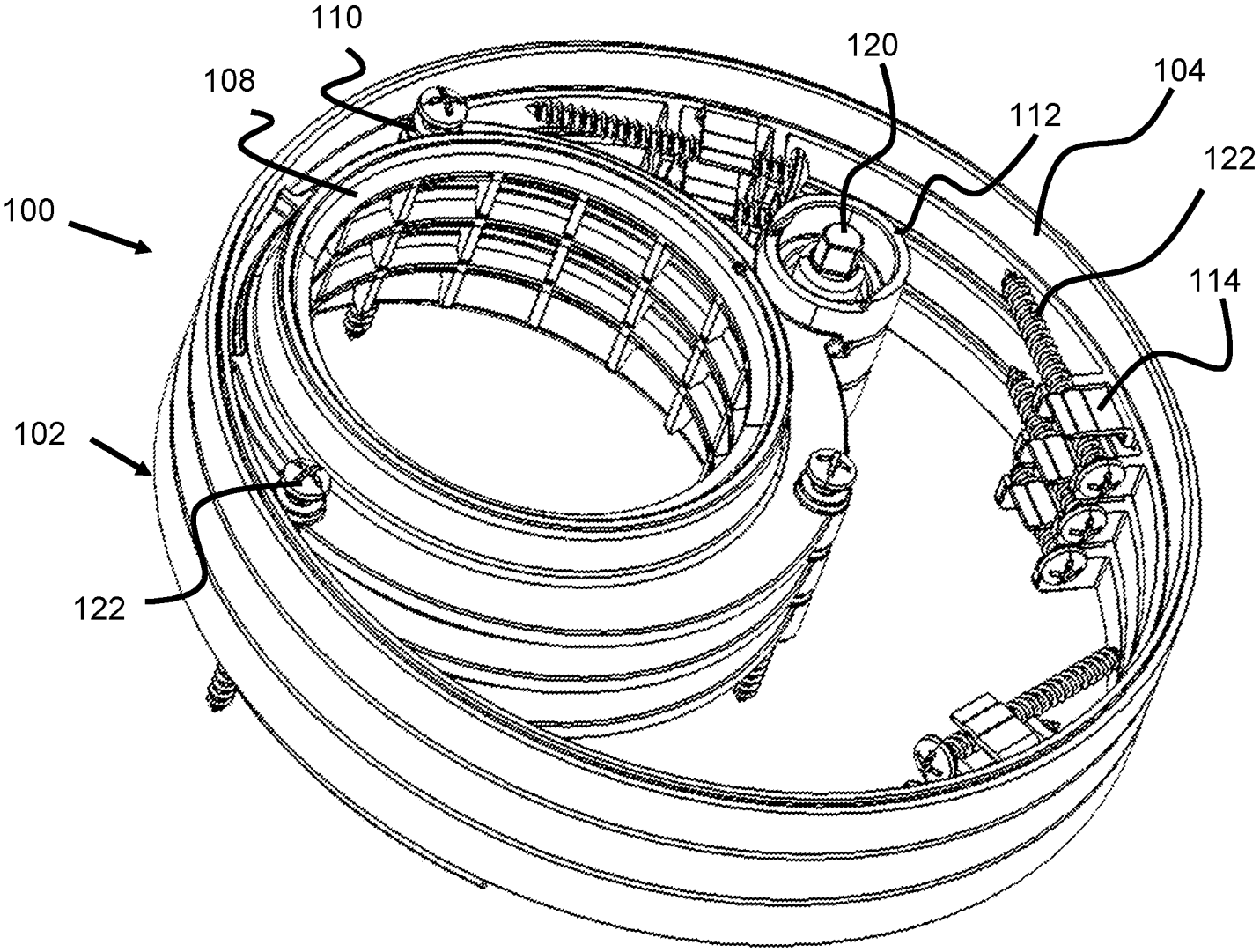
FIG. 10 illustrates a top perspective view of a plurality of spacer rings connected together according to the present invention.
Figure 11:
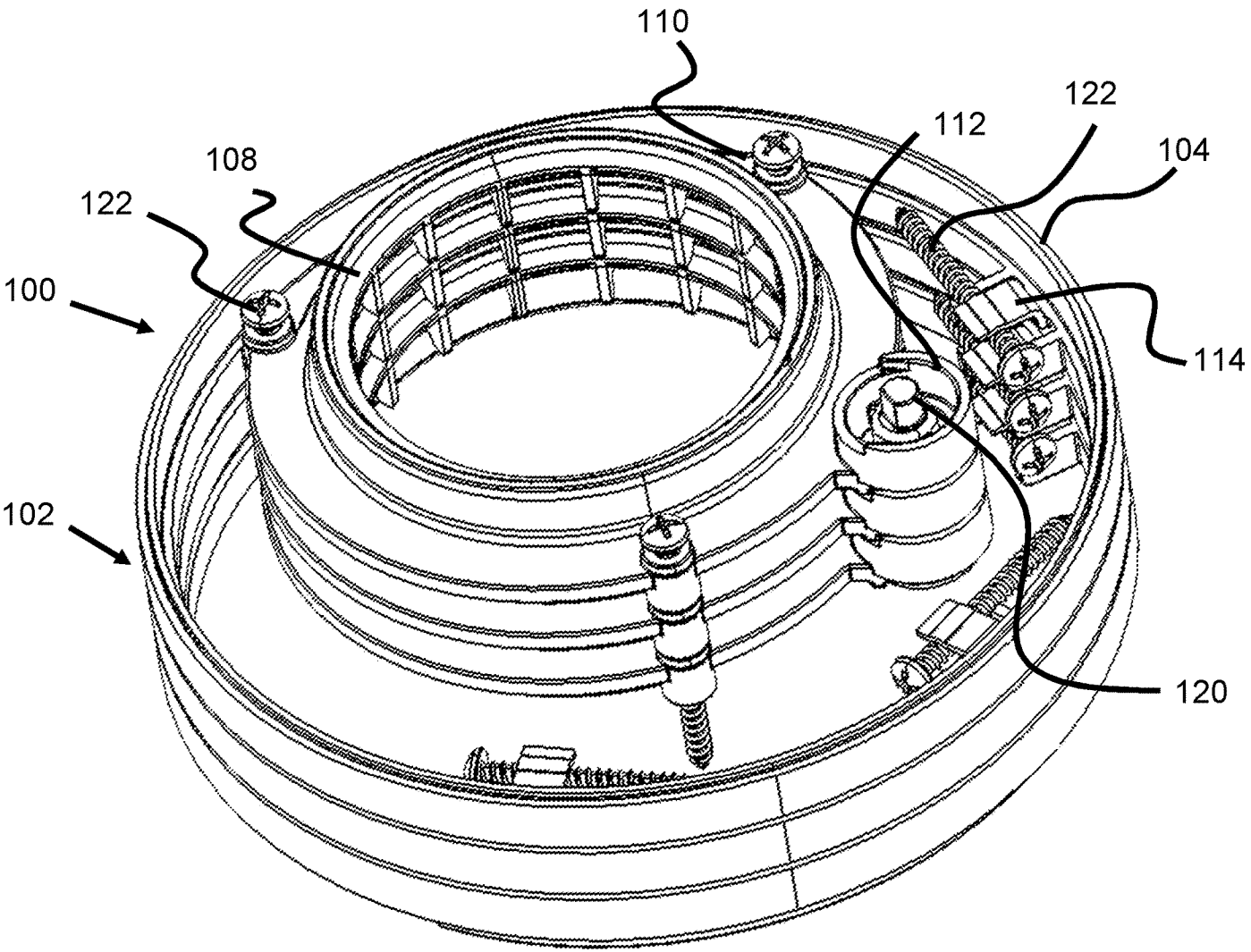
FIG. 11 illustrates a bottom perspective view of a plurality of spacer rings connected together according to the present invention.
Figure 12:
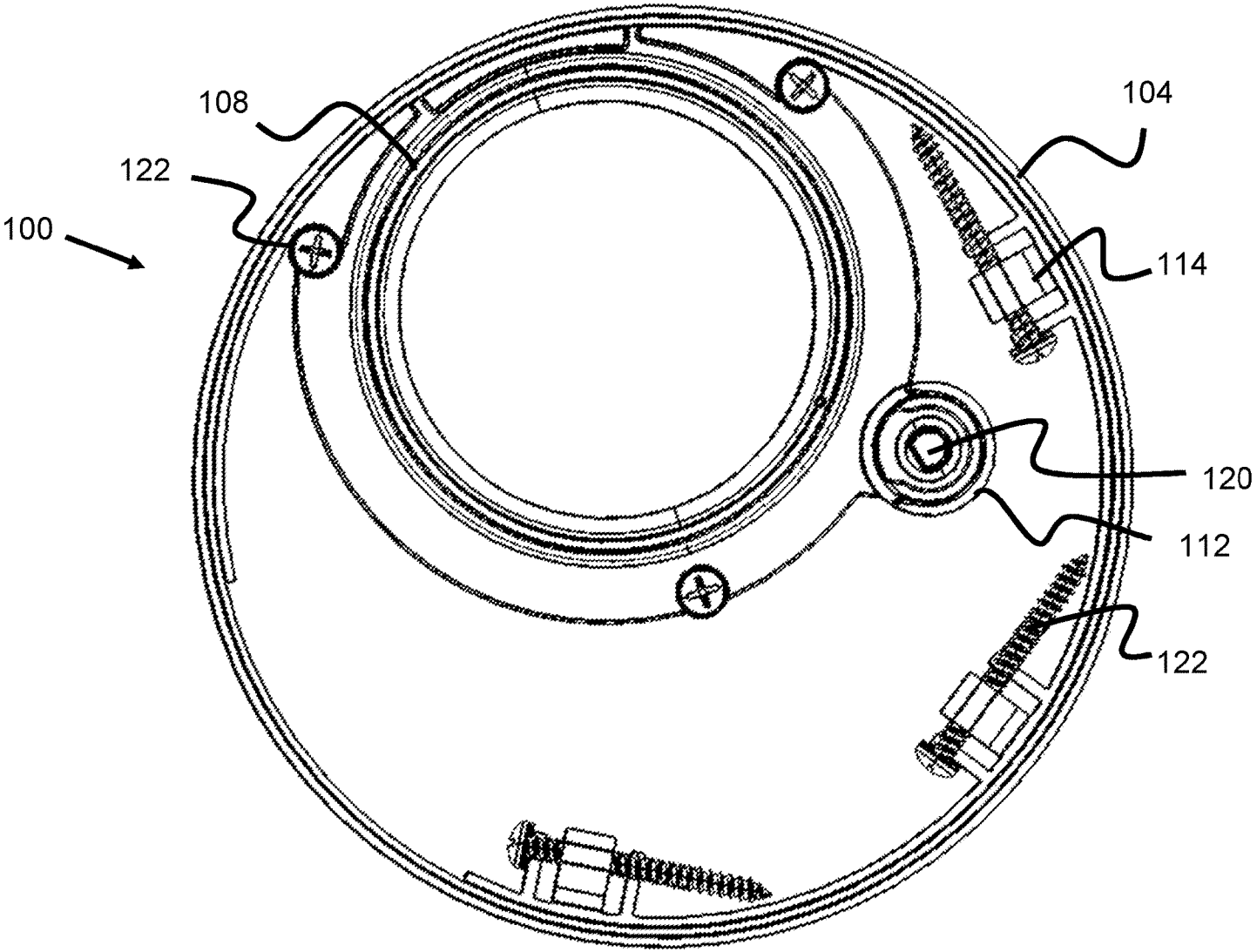
FIG. 12 illustrates a top view of a plurality of spacer rings connected together according to the present invention.
Figure 13:
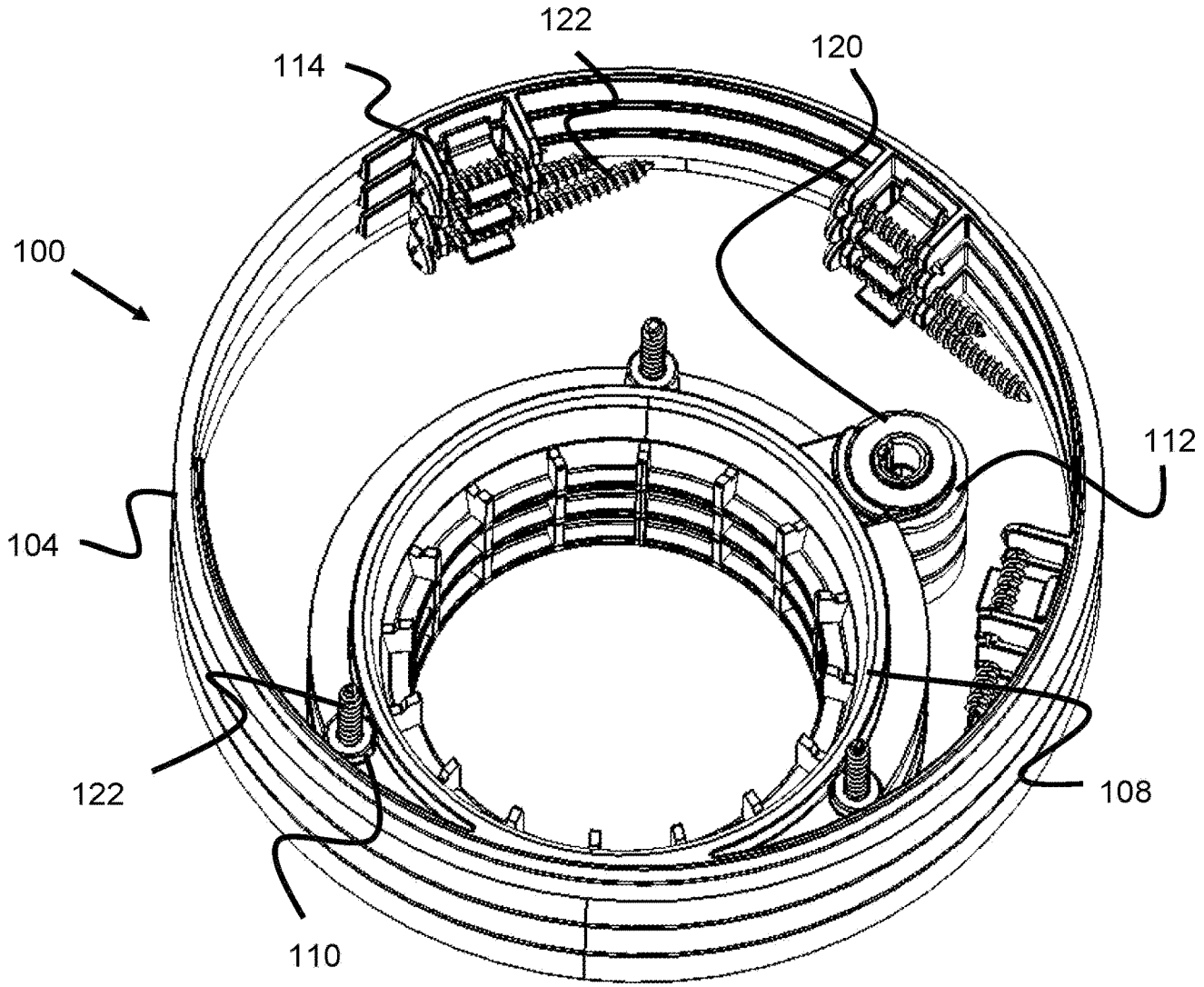
FIG. 13 illustrates a bottom perspective view of a plurality of spacer rings connected together according to the present invention.

The spacer ring 102 also includes a pilot valve adjustment ring 112 which is positioned over the pilot valve actuator knob 18. To prevent the flow adjustment knob 18 from being at a lower elevation than the surrounding cover 14, a knob adapter 120 can be placed over the original knob 18 to increase its height. As seen in FIGS. 7-9, the adapter 120 has a flange 120A which is positioned under the ridge 112A (FIG. 5) to retain the adapter 120 after assembly of the spacer ring 102.

Figure 14:
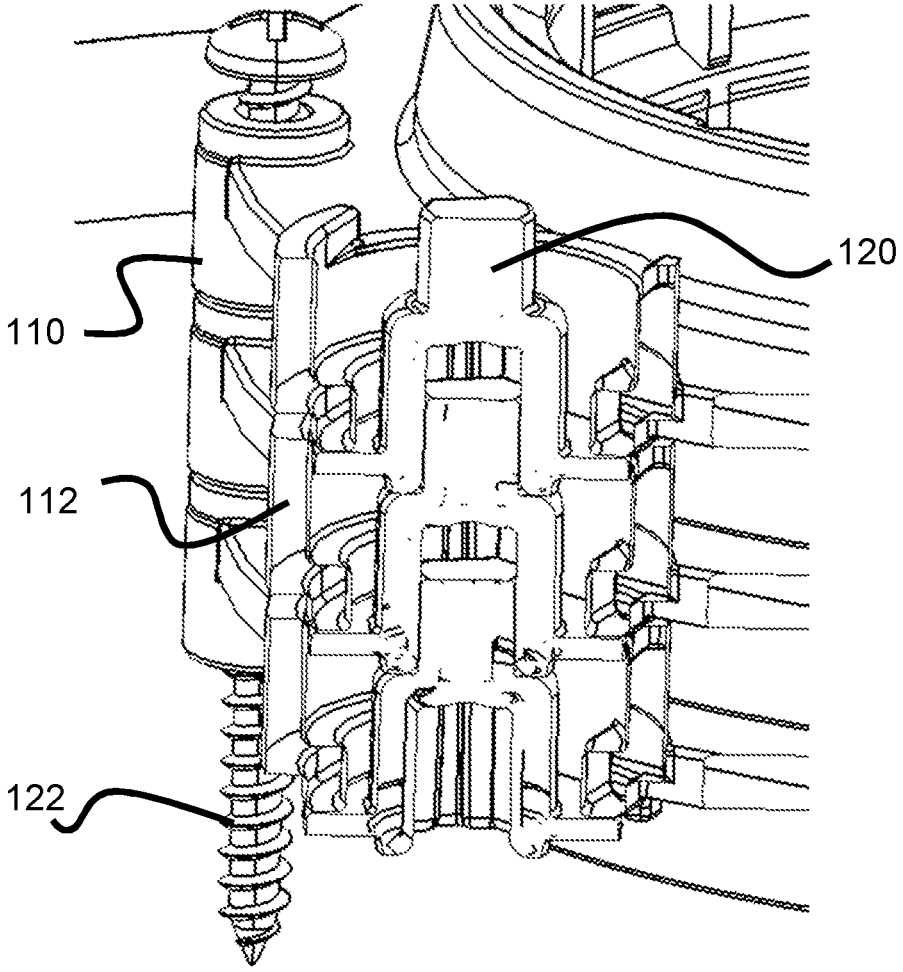
FIG. 14 illustrates a cross sectional view of a plurality of knob adapters according to the present invention.
Figure 17:
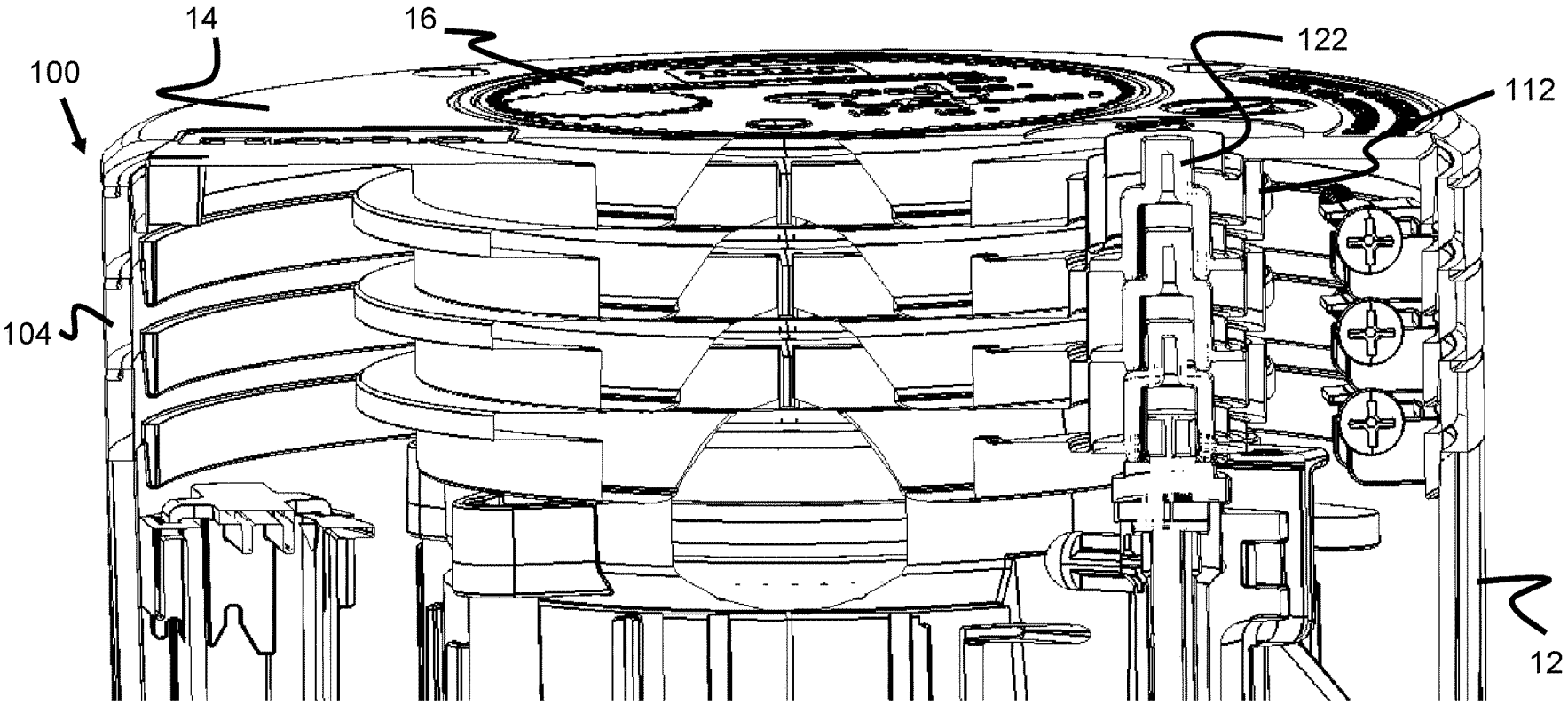
FIG. 17 illustrates a cross sectional view of a plurality of spacer rings in a sprinkler according to the present invention.
Figure 18:
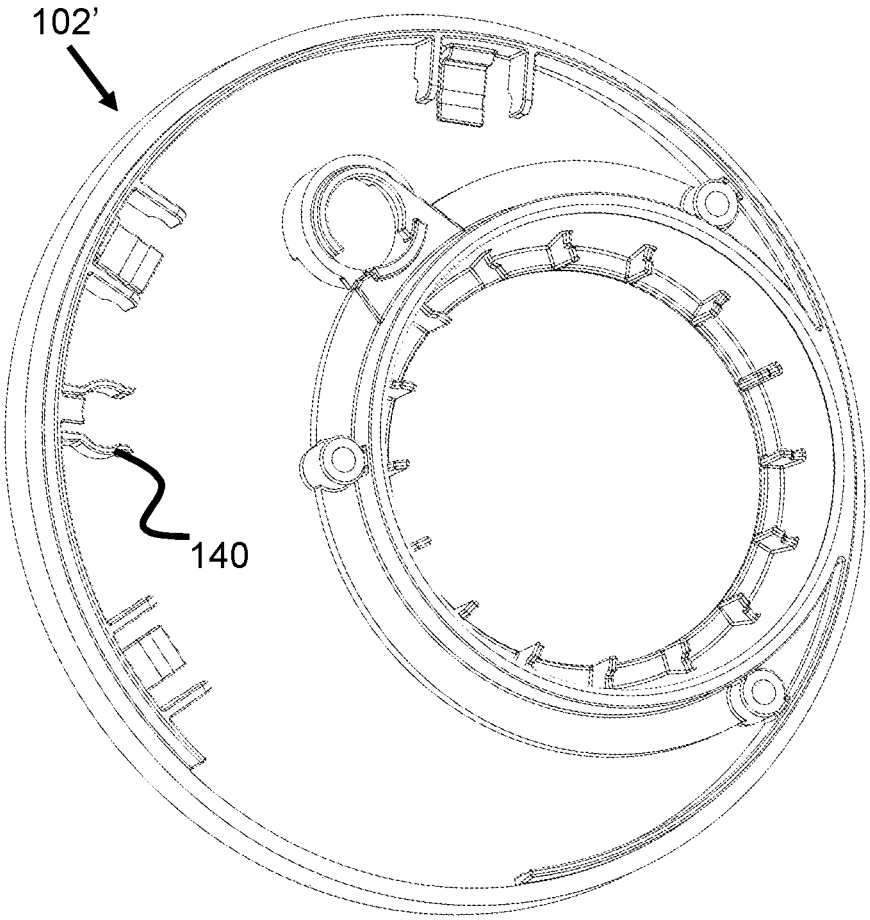
FIG. 18 illustrates a spacer ring according to the present invention.
Figure 19:
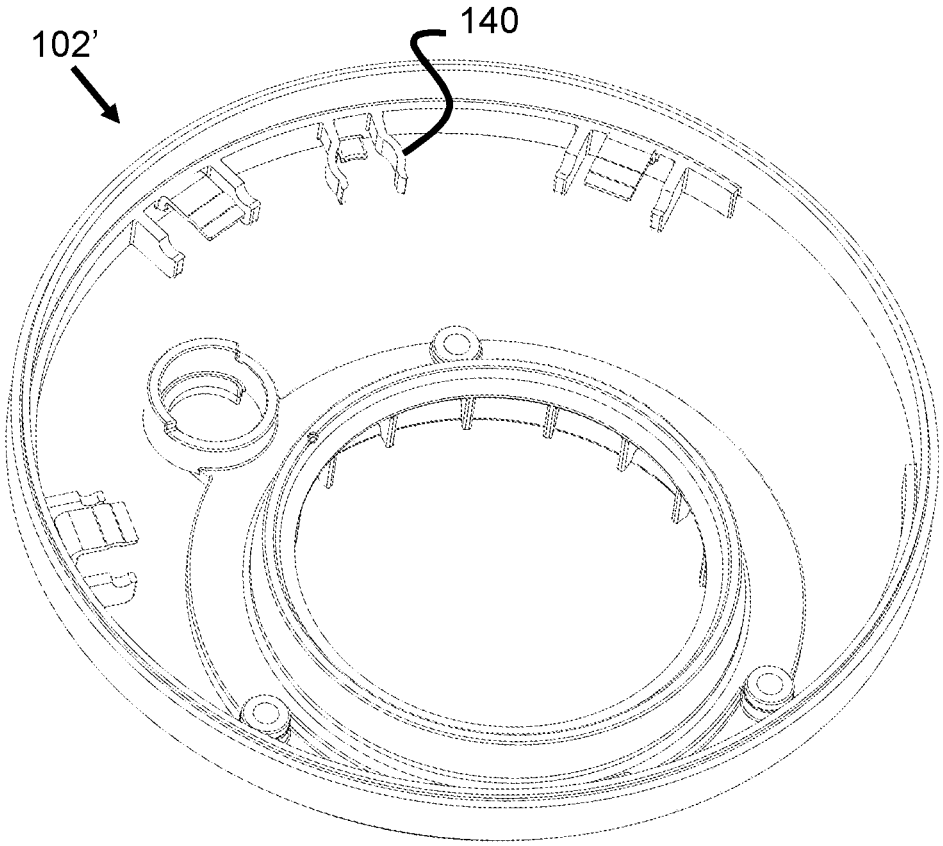
FIG. 19 illustrates a spacer ring according to the present invention.
Figure 20:
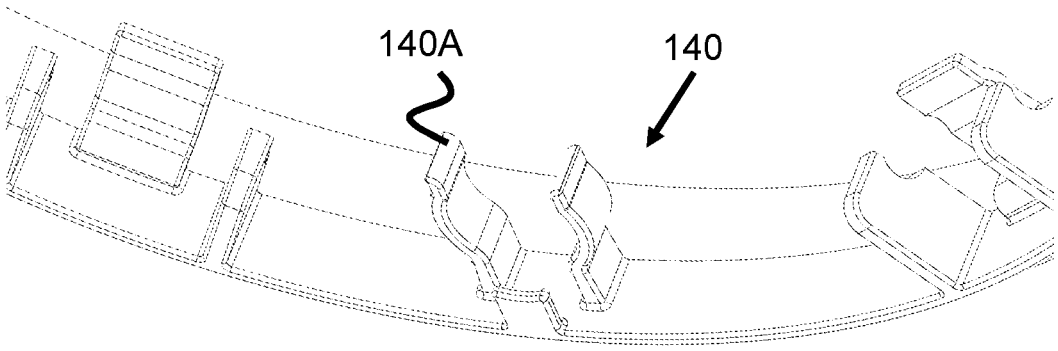
FIG. 20 illustrates a spacer ring according to the present invention.
Figure 21:
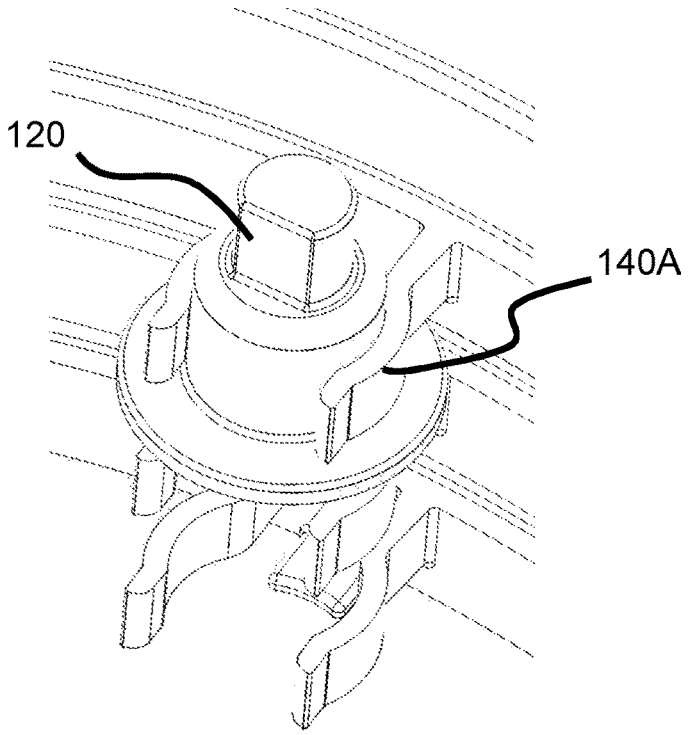
FIG. 21 illustrates a knob adapter holder according to the present invention.

The adapter 120 is also shaped to be stackable with other adapters 120, if multiple spacer rings 102 are used. Specifically, the underside of the adapter 120 includes a cavity 120C that is sized and shaped to accommodate the raised portion 120B. Both the cavity 120C and the raised portion 120B have a non-cylindrical shape (e.g., a flat portion) so that two or more of the adapters 120 rotationally engage each other when stacked (i.e., they don't rotate independent of each other). FIGS. 14 and 17 best illustrate this stacking of adapters 120.

Figure 6:
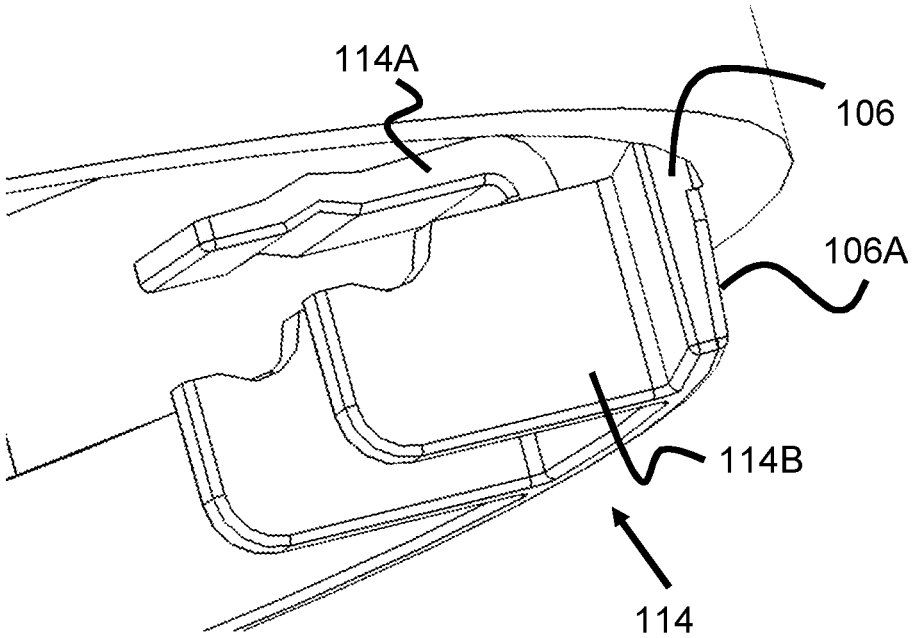
FIG. 6 illustrates a screw retainer according to the present invention.

As best seen in FIG. 6, the spacer ring 102 includes a lower ridge 106 that slides within and against the walls of the sprinkler body 12, allowing the lower surface of the main ring body 104 to rest on the top surface of the wall of the sprinkler body 12. Preferably, this lower ridge 106 has an outer surface 106A that has an angled or wedge shape. This shape allows the ridge 106 to apply a small amount of outward pressure on the walls of the sprinkler body 12 to reduce stress and increase the life of the sprinkler body 12. In this respect, the main ring body 104 has a shape or footprint that is generally similar to that of the sprinkler body 12 and the top cover 14.

As previously discussed, a user can stack multiple spacer rings 102 on top of each other to achieve a desired height. For example, FIGS. 2 and 10-17 illustrate various views of three spacer rings 102 stacked together on a sprinkler 10. In one embodiment, several spacer rings 102 (e.g., 3) are sold together as a kit, along with a connection mechanism (appropriately-sized screws 122) and adapters 120.

Since the final height of the sprinkler 10 may vary depending on the number of spacer rings 102 that are used, the height adjustment mechanism 100 is preferably sold with several different length screws 122 that are positioned through screw holes 110 to secure the rings 102. For example, if three spacer rings 102 are used, a relatively long screw 122 will be needed, but if only one spacer ring 102 is used, a relatively short screw 122 will be needed.

As best seen in FIGS. 6 and 10-13, each ring 102 may include a screw retainer 114 to retain any unused screws 122. In one embodiment, the screw retainer 114 includes two bottom arm members 114B that have a top surface that is curved to accommodate a screw 122. A top arm member 114A extends above the bottom arm members 114B and has a bottom surface with a curved channel to accommodate the screw 122. In this respect, the screw 122 can be horizontally moved into engagement with the arm members 114A, 114B for storage and possible later use.

While the spacer rings 102 in the Figures are shown with a riser ring 108 and flow adjustment ring 112 of a specific size, it should be understood that different sizes and positions are also possible. Additionally, other structural features may be included in the spacer rings 102, depending on the sprinkler configuration, such as walls to subdivide the sprinkler's internal compartment or additional rings for other adjustment mechanisms accessible from the top of the sprinkler.

Figure 15:
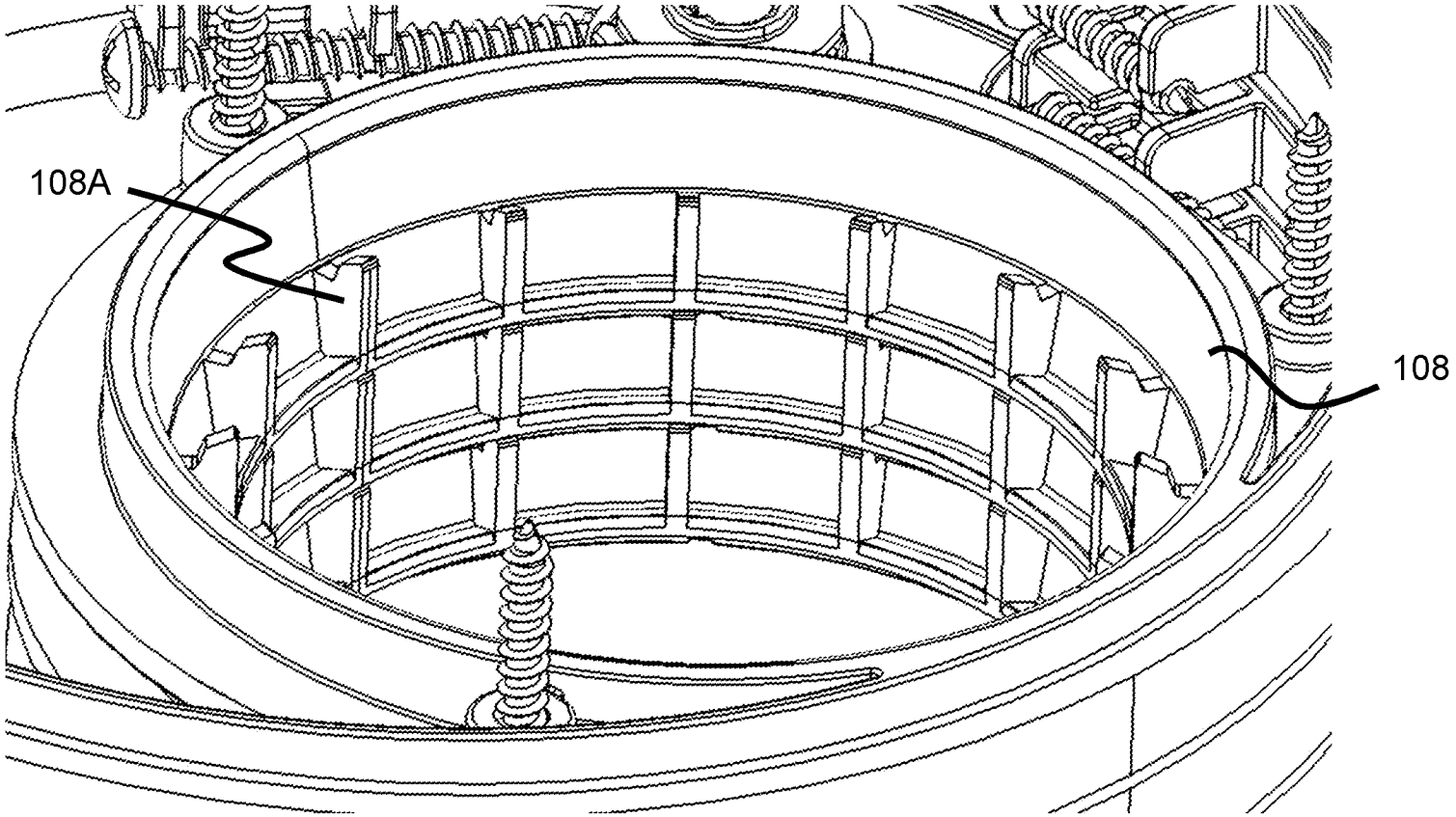
FIG. 15 illustrates a perspective view of a riser ring according to the present invention.
Figure 16:
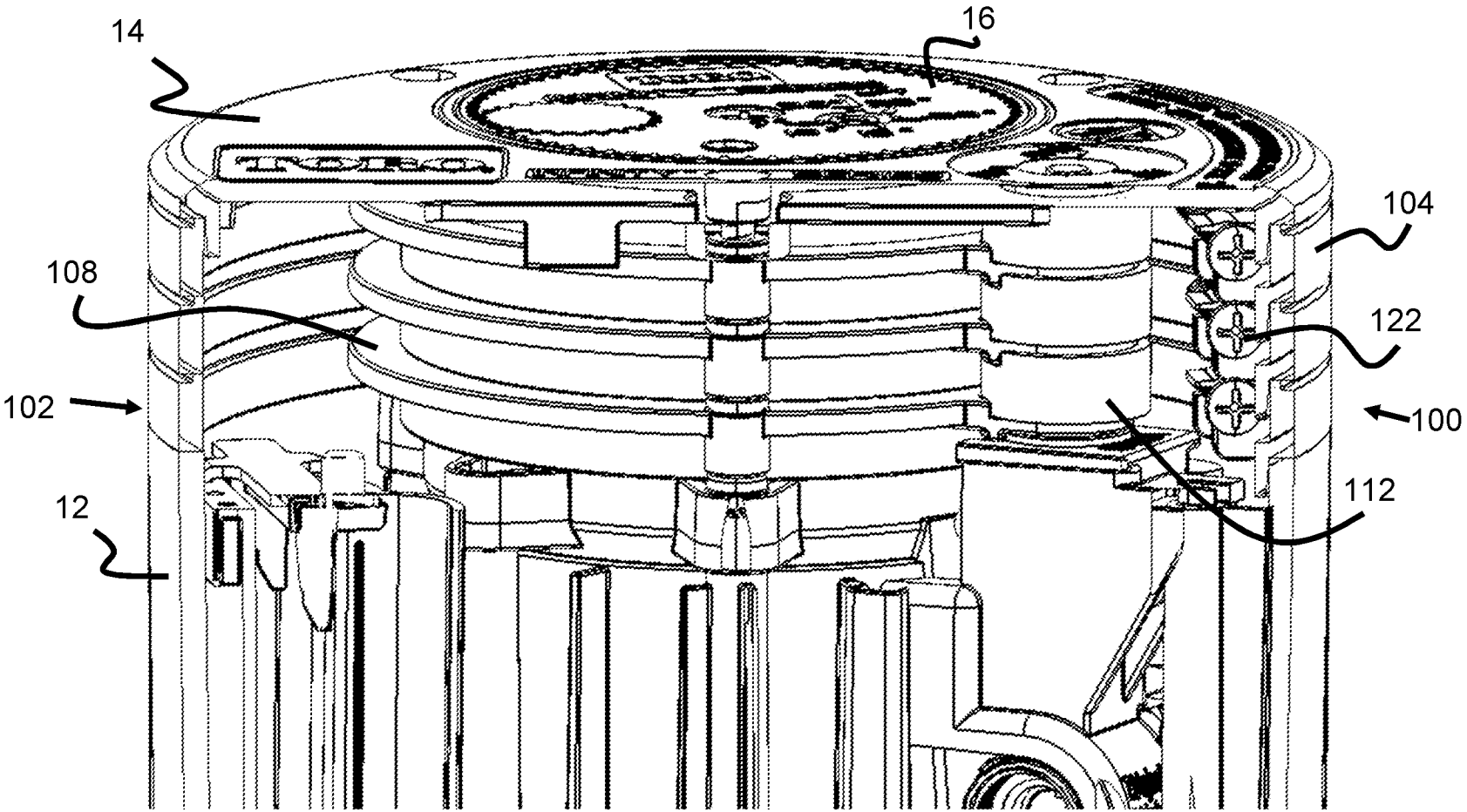
FIG. 16 illustrates a cross sectional view of a plurality of spacer rings in a sprinkler according to the present invention.

As seen in FIG. 15, one embodiment of the spacer ring 102 includes a plurality of fins 108A that extend from an interior side surface of the riser ring 108. The gap between these fins 108A provides a space for any debris that enters the riser ring 108 and can therefore help prevent this debris from hindering movement of the riser 16.

FIGS. 18-21 illustrate an alternate embodiment of a spacer ring 102' having an adapter holder 140 for holding unused adapters 140 (e.g., when a spacer ring 102' is not in use). The adapter holder 140 comprises two arms 140A having curved regions that are spaced apart from each other so as to be able to engage the middle portion of the adapter 120. A rear arm can also be included to help space the adapter away from the inner wall of the spacer ring 102'.

Figure 22:
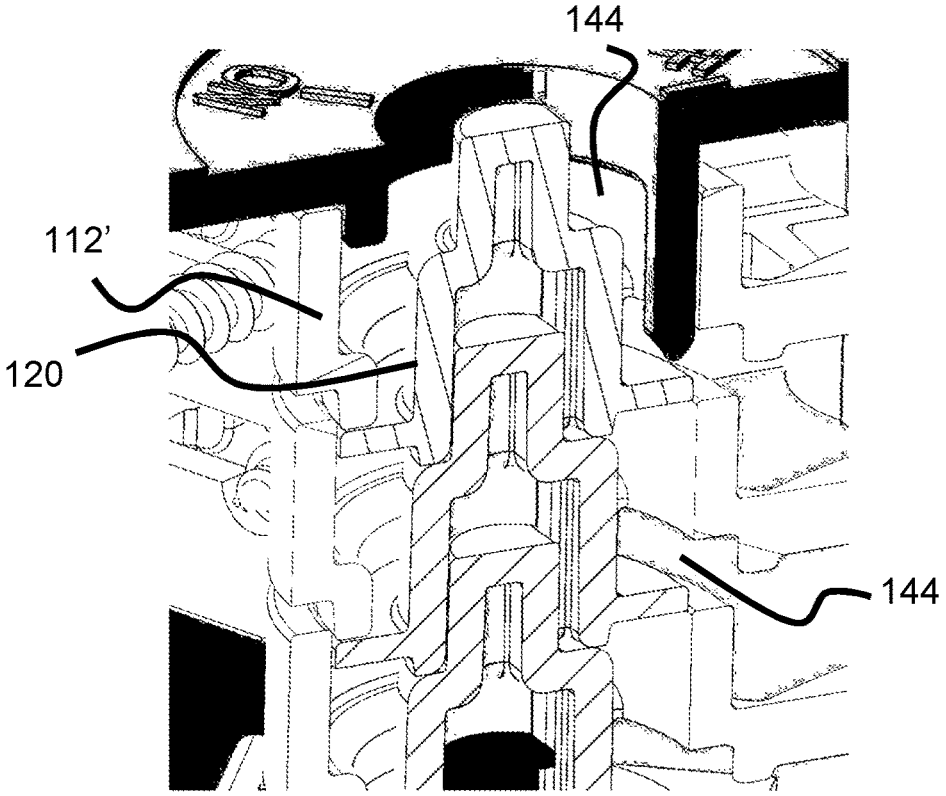
FIG. 22 illustrates a plurality of stacked knob adapters according to the present invention.

FIG. 22 illustrates another embodiment of a spacer ring having a pilot valve actuator ring 112' with a bottom portion that is cut away to form a gap 144 between the ring 112' and the adapter 120. This gap 144 allows debris to fall through instead of getting wedged between the adapter 120 and the ring 112'.

While the one or more spacer rings 102 have been described, other structures are also possible. For example, the height adjustment mechanism may include a single, unitary top cover and spacer ring that completely replaces the top cover 14 of the sprinkler. In the case of sprinklers that do not have an outer compartment, the spacer ring may only consist of the riser ring 108 portion.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A height adjustment mechanism for an irrigation sprinkler, comprising:

a first spacer comprising a main body ring shaped to removably engage against a top region of an outer wall of said irrigation sprinkler and to connect to 1) a top cover of said irrigation sprinkler, or 2) to a second spacer; the first spacer further comprising a riser ring supported in a concentric and offset position within said main body ring, and being sized and positioned to allow a riser assembly of said sprinkler to move vertically therethrough.

2. The height adjustment mechanism of claim 1, wherein said riser ring prevents a top surface of said riser assembly from passing through it.

3. The height adjustment mechanism of claim 1, further comprising a knob adapter shaped to engage a knob on a top of said irrigation sprinkler; said knob further engaging with said first spacer.

4. The height adjustment mechanism of claim 1, further comprising a first set of screws having a first length and a second set of screws having a second length.

5. The height adjustment mechanism of claim 1, wherein said main body ring is configured to hold a screw horizontally.

6. The height adjustment mechanism of claim 2, wherein said riser ring further comprises a plurality of vertical fins.

7. The height adjustment mechanism of claim 1, further comprising a second spacer shaped to removably engage with a top region of said first spacer.

8. The height adjustment mechanism of claim 7, further comprising a third spacer shaped to removably engage with a top region of said second spacer.

9. A height adjustment kit for an irrigation sprinkler, comprising:

a first spacer configured and shaped to removably engage with a top region of said irrigation sprinkler and with a top cover of said irrigation sprinkler; said first spacer comprising 1) a main body ring having a first diameter and free space within said first diameter, and 2) a riser ring fixed concentrically within said free space of said main body ring and having a second diameter that is smaller than said first diameter; and, a second spacer shaped to removably engage with a top region of said first spacer.

10. The height adjustment kit of claim 9, further comprising a first set of screws having a first length and a second set of screws having a second length that is longer than said first length.

11. The height adjustment kit of claim 10, further comprising a third spacer shaped to removably engage with a top region of said second spacer.

12. The height adjustment kit of claim 11, further comprising a plurality of knob adapters.

13. The height adjustment kit of claim 12, wherein said height adjustment kit is configured to connect to an irrigation sprinkler with a top-accessible compartment.

14. A height adjustment kit for an irrigation sprinkler, comprising:

a first spacer shaped to removably engage with a top region of said irrigation sprinkler; and, a connection mechanism that removably connects said first spacer to said irrigation sprinkler; wherein the connection mechanism comprises a first set of screws having a first length, and, a second set of screws having a second length that is longer than said first length.

* * * * *